US007055227B2

(12) United States Patent
Love et al.

(10) Patent No.: US 7,055,227 B2
(45) Date of Patent: Jun. 6, 2006

(54) PROCESS FOR FACE FINISHING FABRICS AND FABRICS HAVING GOOD STRENGTH AND AESTHETIC CHARACTERISTICS

(75) Inventors: Franklin S. Love, Columbus, SC (US); James T. Greer, Moore, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/304,375

(22) Filed: Nov. 26, 2002

(65) Prior Publication Data

US 2004/0098809 A1 May 27, 2004

(51) Int. Cl.
*D06C 11/00* (2006.01)

(52) U.S. Cl. ..... 28/167; 28/104; 28/165; 28/163; 26/28

(58) Field of Classification Search ..... 28/104, 28/105, 167, 162, 163, 168, 169, 165; 26/27, 26/28, 29 R, 7, 8 R, 30; 428/88, 89, 91
See application file for complete search history.

(56) References Cited

U.S. PATENT DOCUMENTS 3,747,161 A * 7/1973 Kalwaites ..... 28/105
3,865,678 A * 2/1975 Okamoto et al. ..... 428/91
4,233,349 A * 11/1980 Niederhauser ..... 428/92
4,251,587 A * 2/1981 Mimura et al. ..... 442/274
4,291,442 A * 9/1981 Marco ..... 28/159
4,316,928 A 2/1982 Otto
4,329,763 A * 5/1982 Alexander et al. ..... 28/104
4,468,844 A 9/1984 Otto
4,497,095 A * 2/1985 Minemura et al. ..... 26/2 R
4,512,065 A 4/1985 Otto
4,612,688 A * 9/1986 Gerlach et al. ..... 28/104
4,743,483 A * 5/1988 Shimizu et al. ..... 428/89
4,774,110 A * 9/1988 Murakami et al. ..... 427/365
4,951,366 A 8/1990 Geller
4,967,456 A 11/1990 Sternlieb et al.
4,995,151 A 2/1991 Siegel et al.
5,136,761 A 8/1992 Sternlieb et al.
5,235,733 A * 8/1993 Willbanks et al. ..... 28/105
5,281,441 A * 1/1994 Kasai et al. ..... 28/104
5,414,913 A 5/1995 Hughes
5,505,739 A 4/1996 Montesano
5,526,557 A 6/1996 Dalla Vecchia
5,632,072 A 5/1997 Simon et al.
5,752,300 A 5/1998 Dischler
5,791,028 A 8/1998 Zolin
5,806,155 A 9/1998 Malaney et al.

(Continued)

OTHER PUBLICATIONS

Joseph, Marjory L. "Inductory Textile Science" 1986 CBS College Publishing, Fifth Edition, pp. 299-301.*

*Primary Examiner*—Amy B. Vanatta
(74) *Attorney, Agent, or Firm*—Terry T. Moyer; Sara M. Current

(57) ABSTRACT

A process for face finishing fabrics, and in particular fabrics containing filaments, to provide them with good aesthetic characteristics is described. In addition, fabrics made from filaments having aesthetic characteristics and surface effects similar to those of fabrics made from spun yarns are described. Also, items of napery made from filaments and having good surface effects and low pick and snag performance are described. The process involves pre-abrading a fabric, such as one made from filaments, and then subjecting it to a high energy fluid treatment process.

11 Claims, 6 Drawing Sheets

U.S. PATENT DOCUMENTS 5,815,896 A 10/1998 Dischler
5,943,745 A 8/1999 Dischler
5,970,583 A * 10/1999 Groten et al. ..... 19/296
6,233,795 B1 5/2001 Dischler
6,242,370 B1 6/2001 Dischler
6,253,429 B1 7/2001 Zolin
6,260,247 B1 7/2001 Dischler et al.
6,269,525 B1 8/2001 Dischler et al.
6,295,706 B1 * 10/2001 Strahm ..... 28/167
6,343,410 B1 2/2002 Greenway et al.
6,345,421 B1 2/2002 Dischler
6,442,809 B1 9/2002 Greenway et al.
6,442,810 B1 9/2002 Greenway et al.
2003/0088957 A1 * 5/2003 Emery et al. ..... 28/162

* cited by examiner

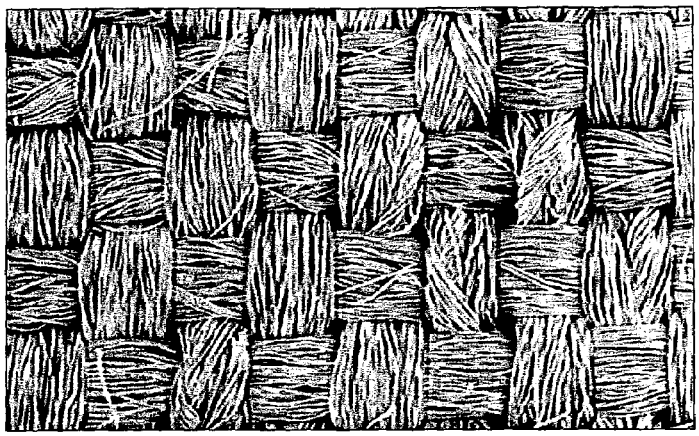
FIG. –3A–
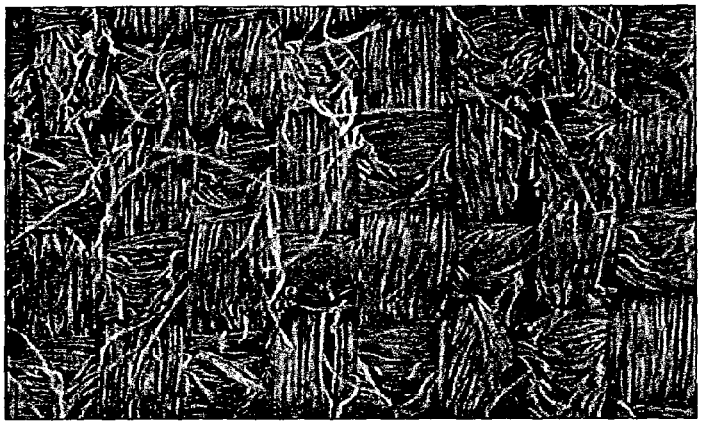
FIG. –3B–
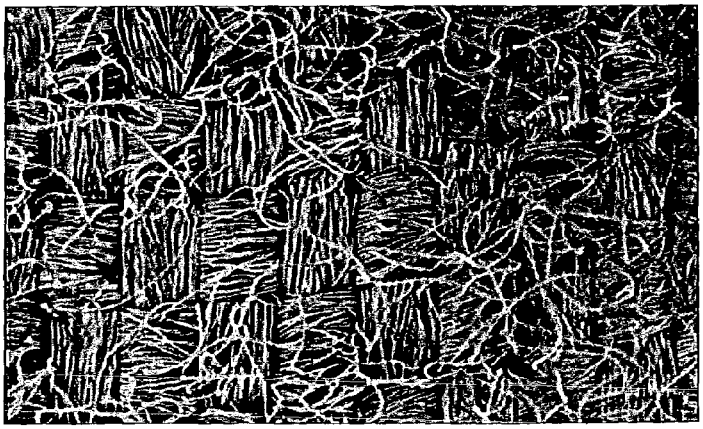
FIG. –3C–

PROCESS FOR FACE FINISHING FABRICS AND FABRICS HAVING GOOD STRENGTH AND AESTHETIC CHARACTERISTICS

BACKGROUND OF THE INVENTION

Conventional fabric fluid treatment processes designed to enhance the surface characteristics of fabrics have been limited to use on fabrics including spun yarns, in order that sufficient fiber free ends are available for the fluid treatment process to raise and entangle, and to form the surface effect. Conventionally, fluid treatment processes have not been considered to be effective on fabrics made primarily from filament fibers, such as all filament fabrics. One attempt to use a hydraulic treatment process to enhance an all-filament fabric is described in U.S. Pat. No. 5,806,155 to Malaney et al. That patent describes the use of a hydraulic treatment process to "uniformly and continuously" impact an all-filament woven fabric at a particular level of energy in order to achieve controlled porosity and uniform spacing of the yarns. However, as acknowledged by Malaney in that reference, there are no free fiber ends in the fabric to be entangled or which can be used to form a surface effect on the fabric. (For purposes of this invention, the term "surface effect" is intended to describe a nap or pile of fibers on the surface of the fabric, which provide it with a variety of characteristics, e.g. softness, increased compression, etc.)

Spun yarns are commonly used in the production of fabrics for a variety of end uses, in particular, where aesthetics such as a soft hand are desired. As will be readily appreciated by those of ordinary skill in the art, spun yarns are those made from a plurality of relatively short fibers (i.e. staple fibers) that are formed into a yarn that is typically held together by twist. Some disadvantages that are commonly associated with spun yarns are that they are often not as strong as their filament counterparts and they can tend to degrade during use and laundering, leading to the production of lint, fabric weight loss, and loss of fabric strength. In addition, fabrics made from spun yarns tend to retain soil to a greater extent than fabrics made from filaments.

Fabrics made from filaments thus are generally considered to have greater strength and soil release performance than those made from spun yarns, though they generally are not considered to be as soft or aesthetically pleasing as the fabrics made from spun yarns. Therefore, yarns made from filaments are often put through a texturing process designed to bulk out the filaments and make them more compressible and pleasant to the touch. However, fabrics made from the textured filaments are still considered to have only limited to no surface effect, and considerably less surface effect than a comparable fabric made from spun yarns.

One market that has capitalized on the features of filaments is the napery market, and in particular, the rental laundry market. The rental laundry market demands that the fabrics used in the manufacture of its tablecloths and napkins be highly durable, in order that the items can be re-used and laundered a large number of times. In addition, such items need to have good soil release, and need to have a good feel or hand, particularly when they will be used as napkins, since they will contact the user's face.

As noted above, filaments are considered to provide greater durability and soil release than spun yarns. As also noted previously, the fabrics made from filaments have a rough feel and limited to no surface effect. In an attempt to overcome this disadvantage, fabrics made from filaments are typically sanded or otherwise abraded to produce some cut fibers at the fabric surface. However, to achieve an amount of abrasion sufficient to alter the surface characteristics of the fabric, it is typically required that the fabric construction present sufficient available fiber lengths to the abrasion device, in order that an acceptable hand can be achieved at an acceptable level of strength. (See FIG. 1, which illustrates the effect that abrasion intensity as applied to a plain weave fabric has on fabric tear strength.)

In order to present yarn floats that are sufficiently long to receive an effective amount of abrasion by the abrading process, it is customary to provide the fabrics in a 2×1 weave construction. (As will be readily appreciated by those of ordinary skill in the art, this construction provides a plurality of staggered yarn floats, where a yarn extending in one direction crosses over two or more yarns extending in the other direction. In this way, the float can be sufficiently acted upon by the abrasive action.) Not only does this construction provide greater fiber availability for the abrasion process, but this weave construction is typically considered to have better tear strength as compared with a plain weave construction made from the same yarns.

One problem posed by this construction is that the longer floats have a tendency to pick and snag. When this occurs, filaments or even a whole yarn are pulled outwardly from the fabric, resulting in an unsightly looking defect in the product. These picks and snags can occur routinely from fabric use or from the laundering process, and are a common cause of rental napery products being withdrawn from use. Despite the above-noted disadvantages associated with the 2×1 construction, prior to the present invention, it had been considered to be the only acceptable construction for a filament napery fabric with acceptable surface effects.

SUMMARY

The instant invention is directed to a process for making fabrics made from filaments have aesthetic characteristics simulating those of fabrics made from spun yarns. In addition, the invention is directed to fabrics having spun-like aesthetic characteristics made from filaments. Furthermore, the invention enables the achievement of fabrics having a durable soft hand, good fabric durability and strength, good soil release, good color retention, improved moisture transport and low pill characteristics as compared with similar fabrics made from spun yarns. In addition, the invention includes fabrics suitable for use in the rental napery market, which have a reduced tendency to pick and snag relative to other napery fabrics made from filaments.

The invention involves providing a fabric containing filaments, and subjecting the fabric to a pre-abrasion step. For example, the fabric can be sanded, brushed, napped, etc., with the goal being to abrade some of the filaments and form some cut fiber ends along the yarns. (For purposes of this disclosure, the term "cut fiber ends" is intended to encompass ends that are severed all the way through, as well as those formed through fiber fibrillation, which is a slicing or peeling of a portion of the fiber.)

The fabric is then subjected to a high energy fluid treatment process, which serves to act on the pre-abraded fabric and create a surface effect on at least one surface of the fabric and/or push cut fiber ends from one surface of the fabric through the dimension of the fabric toward or through to the other fabric surface. For example, the fabric can be treated with high pressure water, gas, or the like. (For purposes of this application, "high energy" is intended to encompass fluids at sufficient pressures and/or velocities to push cut fiber ends through the dimension of the fabric (i.e. invert the pile) and/or entangle fibers, as opposed to simply slightly displacing them, and to push fibers through and/or outwardly from the dimension of the fabric.) Where an amount of energy is described herein as being applied to a fabric, it is understood that those of ordinary skill in the art will recognize that the speed of the fabric through the treatment zone, the dimension of the treatment zone, the pressure and velocity of the fluid as it reaches the fabric, the fluid density and mass, the mass of the fabric presented to the fluid, and the time the fabric is exposed will be coordinated to achieve the desired level of energy application. In addition, the total energy may be applied to the fabric in one stage, through passage through a series of fluid treatment stages.

In the case of multiple treatment stages, they can be achieved by way of plural treatment stages in a single apparatus, or from multiple passes through a single fluid treatment apparatus. Typically, it would be expected that an energy of about 0.0295 horsepower-hr/lb of fabric would perform well in effectively entangling the fibers and raising the fibers to form the surface effect, although other energy levels are contemplated within the scope of the invention, depending on the treatment process utilized, the fabric treated, and the amount of surface effect desired.

BRIEF DESCRIPTION OF THE DRAWINGS

FIG. 3A is a photomicrograph (30× magnification, no tilt) of a fabric in its greige state;

FIG. 3B is a photomicrograph (30× magnification, no tilt) of the fabric shown in FIG. 3A, after it has been pre-abraded;

FIG. 3C is a photomicrograph (30× magnification, no tilt) of the fabric shown in FIG. 3A, after it has been abraded and fluid treated in the manner of the invention;

DETAILED DESCRIPTION

In the following detailed description of the invention, specific preferred embodiments of the invention are described to enable a full and complete understanding of the invention. It will be recognized that it is not intended to limit the invention to the particular preferred embodiment described, and although specific terms are employed in describing the invention, such terms are used in a descriptive sense for the purpose of illustration and not for the purpose of limitation.

The instant invention is directed to a process for enhancing the hand and aesthetic characteristics of fabrics. In particular, the process has been found to be particularly suitable in the enhancement of filament-containing fabrics. In one aspect of the invention, it has been found that fabrics made substantially or substantially entirely from filaments can be made to feel and appear substantially like fabrics made from spun yarns. This can be particularly desirable because fabrics having comparable levels of feel as those made from spun yarns can be achieved at greater levels of strength, durability, soil release, and/or levels of manufacturing ease and efficiency.

The fabric can be produced in any known manner, including but not limited to weaving, knitting, and nonwoven manufacturing processes. As will be appreciated by those of ordinary skill in the art, such fabrics include a plurality of fibers and/or yarns that are interwoven, interknit, or otherwise associated with each other to form a coherent stable structure.

The invention contemplates the use of any type of fibers, including but not limited to synthetic and non-synthetic fibers (e.g. polyester, nylon, rayon, silk, cotton, polylactide based fibers, PTT fibers, wool, aramids, etc.), single or multi-plied yarns, or the like.

The invention involves pre-abrading a fabric, then treating it with a high energy fluid. The pre-abrasion can be performed in any of a variety of ways. For example, the pre-abrading can be performed by processes including, but not limited to, sanding, brushing, napping, wet sueding, dry sueding, or processing by the sanding methods and/or apparatus described in commonly-assigned U.S. Pat. No. 6,233,795 to Dischler, U.S. Pat. No. 6,260,247 to Dischler et al., U.S. Pat. No. 6,269,525 to Dischler et al., U.S. Pat. No. 6,345,421 to Dischler et al., U.S. Pat. No. 4,468,844 to Otto, U.S. Pat. No. 4,512,065 to Otto, U.S. Pat. No. 5,943,745 to Dischler, U.S. Pat. No. 6,242,370 to Dischler, U.S. Pat. No. 5,815,896 to Dischler, and U.S. Pat. No. 5,752,300 to Dischler, the disclosures of which are incorporated herein by reference. For purposes of this disclosure, the term "sanding" is intended in its broadest sense to encompass all types of grits (e.g. sandpaper, sanding films, diamond plated rolls, three-dimensional abrasion such as by using Scotchbrite® grit available from 3M Corporation of St. Paul, Minn., etc.), and grit supports.

Figure 1:
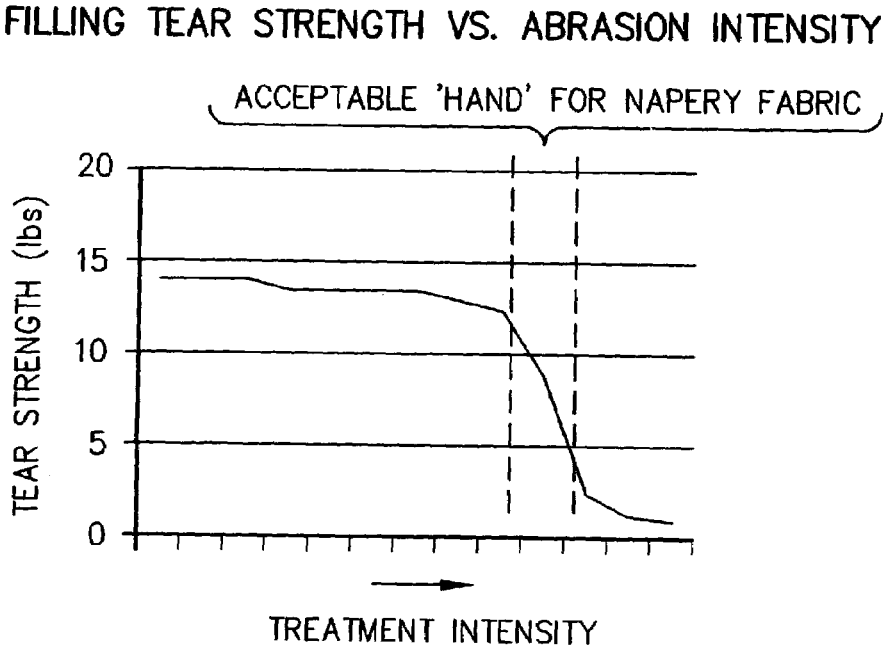
FIG. 1 is a graphical illustration of the effect that abrasion intensity has on the tear strength of a plain weave fabric.
Figure 2:
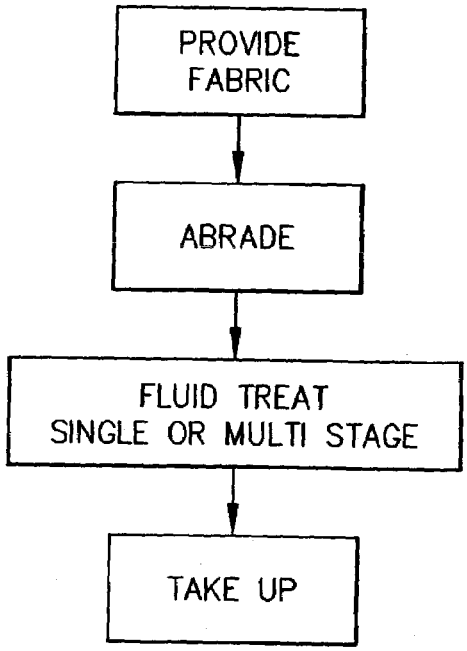
FIG. 2 is a schematic illustration of a process according to the instant invention.
Figure 4A:
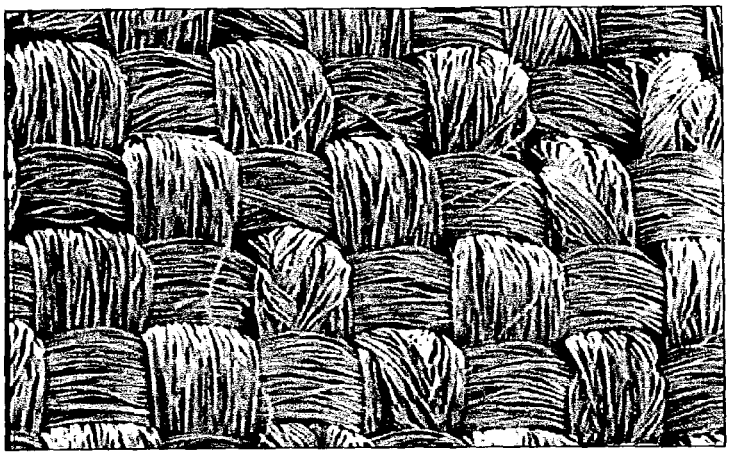
FIG. 4A is a photomicrograph (30× magnification, 45° tilt) of the fabric in FIG. 3A in its greige state.
Figure 4B:
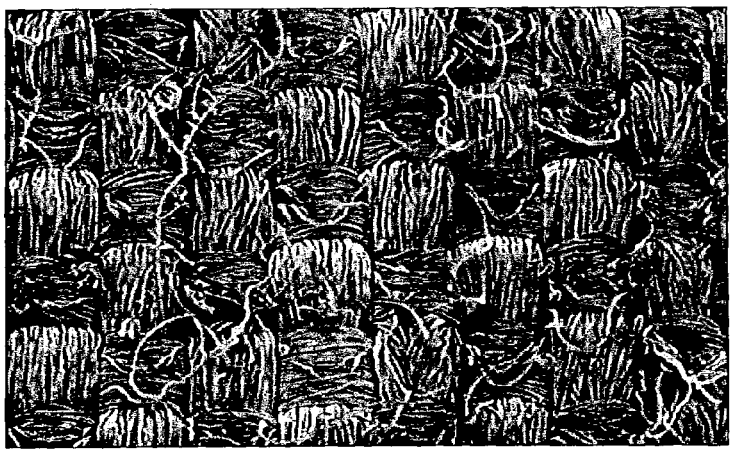
FIG. 4B is a photomicrograph (30× magnification, 45° tilt) of the fabric shown in FIG. 4A, after it has been pre-abraded.
Figure 4C:
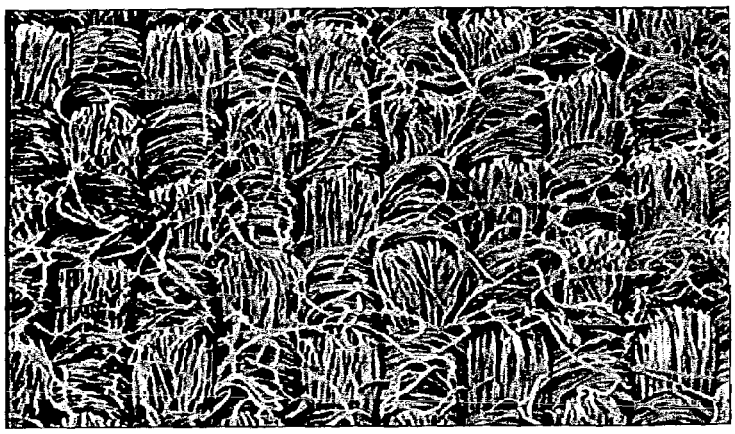
FIG. 4C is a photomicrograph (30× magnification, 45° tilt) of the fabric shown in FIG. 4A, after it has been abraded and fluid treated in the manner of the invention.
Figure 5A:
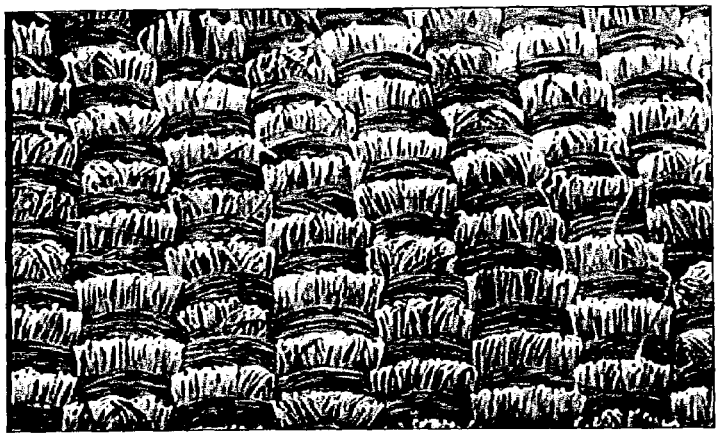
FIG. 5A is a photomicrograph (30× magnification, 75° tilt) of the fabric shown in FIG. 3A in its greige state.
Figure 5B:
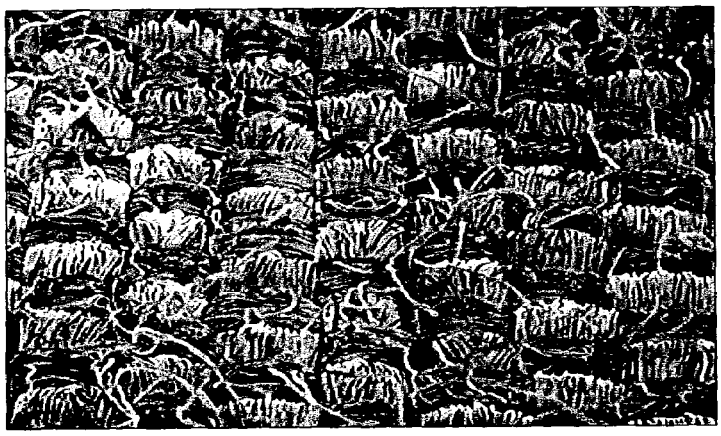
FIG. 5B is a photomicrograph (30× magnification, 75° tilt) of the fabric shown in FIG. 5A, after it has been abraded.
Figure 5C:
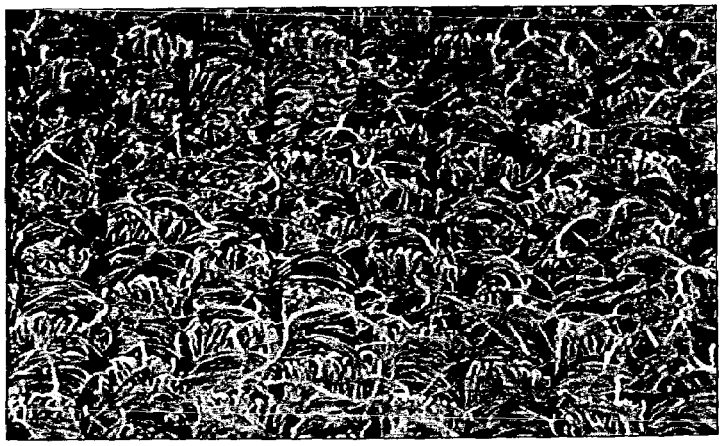
FIG. 5C is a photomicrograph (30× magnification, 75° tilt) of the fabric shown in FIG. 5A, after it has been abraded and fluid treated in the manner of the invention.
Figure 6A:
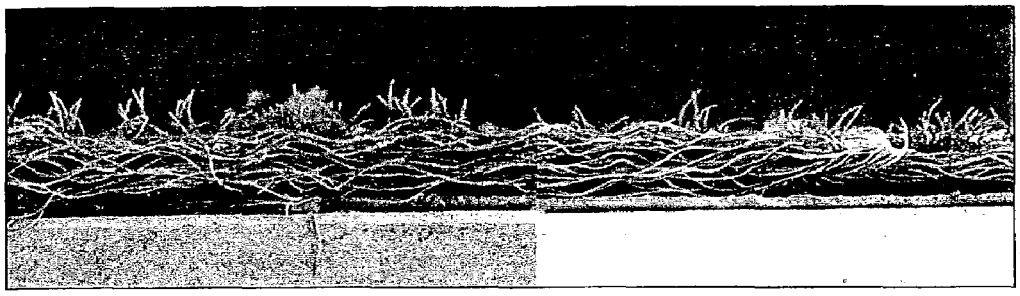
FIG. 6A is a cross-sectional photomicrograph (30× magnification) of the fabric shown in FIG. 3A in its greige state.
Figure 6B:
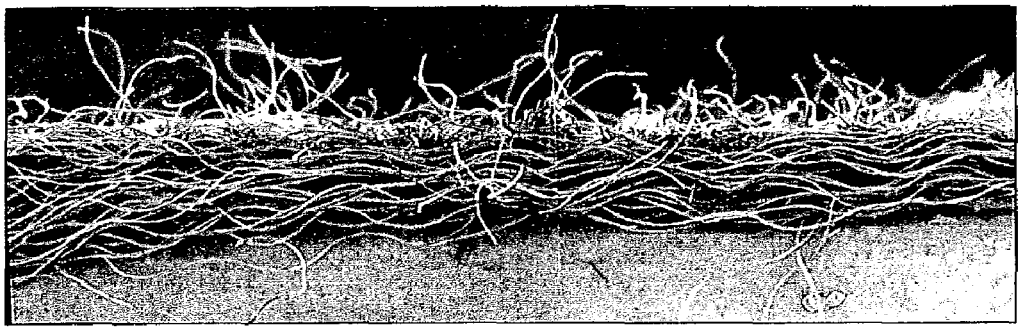
FIG. 6B is a cross-sectional photomicrograph (30× magnification) of the fabric shown in FIG. 3B (abraded only)
Figure 6C:
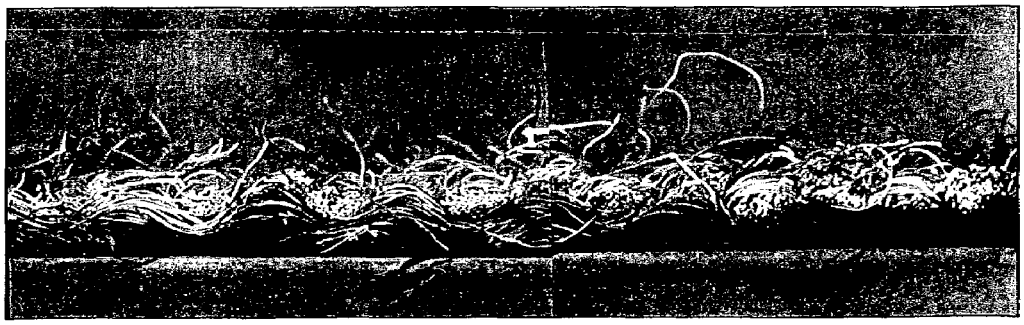
FIG. 6C is a cross-sectional photomicrograph (30× magnification) of the fabric shown in FIG. 3C which had been abraded and fluid treated according to the invention.
Figure 7A:
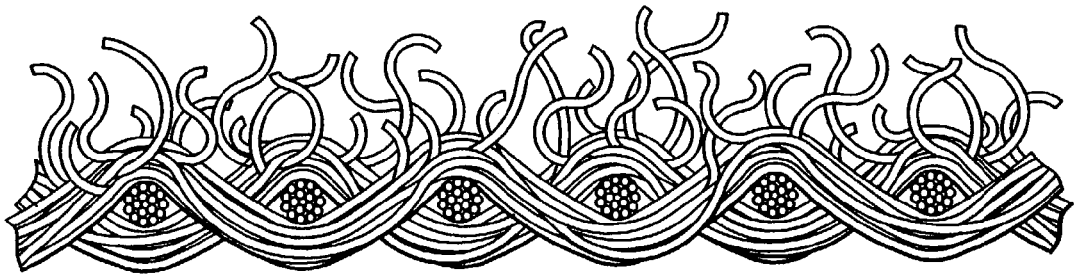
FIG. 7A is an illustration of a cross-sectional view of a fabric which has been abraded on one side only.
Figure 7B:
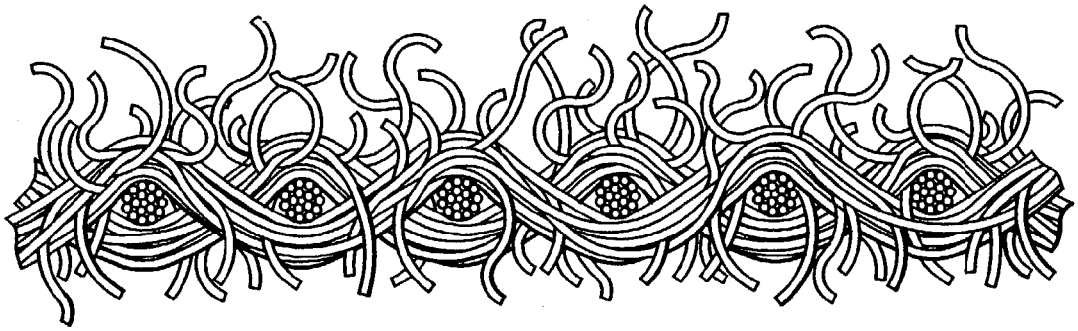
FIG. 7B is an illustration of the fabric of FIG. 7A after it has been subjected to a fluid treatment step in accordance with the instant invention.
Figure 7C:
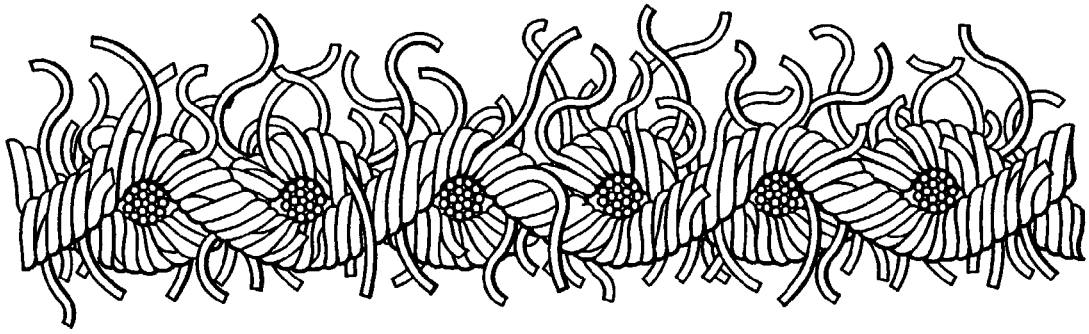
FIG. 7C is an illustration of a fabric made from spun yarns that has been abraded on one side only and subjected to a fluid treatment step in the manner set forth in the invention.

The fabric can be pre-abraded on one or both surfaces, according to the desired amount of surface effect. For example, in one aspect of the invention illustrated in FIGS. 7A and 7B, the fabric is pre-abraded on one surface (FIG. 7A) , with the fluid treatment serving to produce a surface effect on each of the fabric surfaces, by forcing some of the cut fiber ends of the abraded fibers through the fabric to the opposite fabric surface (FIG. 7B). Alternatively, both surfaces of the fabric can be pre-abraded within the scope of the instant invention.

The high energy fluid treatment can be of any variety that functions to entangle fibers within the fabric, including treatment with high pressure gas, treatment with high pressure liquid, or the like. For example, it has been found that a high pressure water treatment of the variety described in commonly-assigned co-pending U.S. patent application Ser. No. 09/344,596 to Emery et al, filed Jun. 25, 1999 works well in the invention. The disclosure of U.S. patent application Ser. No. 09/344,596 to Emery et al., filed Jun. 25, 1999, is incorporated herein by reference. However, other types of fluid treatment apparatus could be used within the scope of the invention, including but not limited to those described in U.S. Pat. No. 5,806,155 to Malaney et al.; U.S. Pat. No. 6,253,429 to Zolin; U.S. Pat. No. 5,632,072 to Simon et al.; and U.S. Pat. No. 6,343,410 to Greenway et al.; U.S. Pat. No. 5,791,028 to Zolin; U.S. Pat. No. 6,442,810 to Greenway et al.; U.S. Pat. No. 6,442,809 to Greenway et al.; U.S. Pat. No. 5,136,761 to Sternlieb et al.; U.S. Pat. No. 4,995,151 to Siegel et al.; U.S. Pat. No. 4,967,456 to Sternlieb et al., the disclosures of which are incorporated herein by reference. The high energy fluid treatment can be performed on both surfaces or on one surface only. As noted above, in some embodiments of the invention (such as when using the fluid treatment apparatus described above in the '596 application to Emery et al), a surface effect may be achieved on both surfaces of the fabric despite fluid treatment being performed only on a single side of the fabric.

As noted previously, the amount of energy applied can be selected to optimize the surface effect on the particular fabric being treated. In addition, the parameters of the particular treatment apparatus can be selected without undue experimentation to achieve the desired level of treatment, so that the desired level of surface effect is achieved for the particular fabric. It is expected that by treating a fabric with at least about 0.0295 hp-hr/lb of energy, a good surface effect could be achieved for many textile fabrics. In some embodiments of the invention, it has been found that an energy application of about 0.0295–0.118 hp-hr/lb achieves a good fabric.

It has surprisingly been found that by pre-abrading a fabric and in particular, a filament-containing fabric, the high energy fluid is able to dramatically change the surface of the fabric far beyond the effects of the abrasion alone. This unique combination of pre-abrasion and fluid treatment has been found to give filament-containing fabrics unique surface effects similar to those of fabrics made from spun yarns. In particular, while abraded fabrics have a flat and rough feel, the fabrics of the instant invention have a number of loopy filament ends that are exposed to the surface, which form a cushioned surface effect. In other words, fibers from both the warp and filling are affected (in contrast to many other processes that affect only one set of yarns) and a plurality of short round loops with free ends are produced, with the fibers being entangled with those from other adjacent yarns, to form a dense cover of fibers.

In addition, the cut fiber ends had a length of about 1–1½ floats, which resulted in a unique short, soft surface effect, with the fibers being entangled with other adjacent fibers, and throughout the thickness dimension of the fabric. In contrast, surface effects produced from conventional processes such as brushing result in long pulled fibers that do not form a cohesive entangled surface effect. This short fiber feature is of particular advantage because long pulled fibers have a tendency to exacerbate fabric pilling. Therefore, in one aspect of the invention, it is desirable that the pre-abrasion and fluid treatment processes be performed to produce cut fiber ends having a length of about 1.5 float lengths or less.

Intermediate steps such as dyeing, chemical treatment, etc. can be performed where desired, either before pre-abrasion, after pre-abrasion but before fluid treatment, or after fluid treatment. In addition, the pre-abrasion and fluid treatment operations can be performed in-line, or as separate operations. Following fluid treatment, the fabric can be finished in a conventional manner. Conventional chemistries such as soil release chemicals, wicking agents, handbuilders, anti-stats, etc. can also be added at any desired point in the process.

The fabrics produced by the process of the invention have a variety of unique combinations. Of particular significance is the fact that fabrics made from filaments can be made to look and feel like fabrics made from spun yarns. In this way, a unique fabric which has the desirable properties associated with filaments (e.g. strength, low linting, good soil release and the like) can be achieved but with the aesthetic characteristics associated with fabrics made from spun yarns.

As will be readily appreciated by those of ordinary skill in the art, the fabrics of the invention have utility in a broad range of end uses where a surface effect is desired, including but not limited to napery, home furnishings, apparel of all types, industrial products, upholstery, shower curtains, draperies, shades, aprons, linings, bedding, casket linings, flags, labels, bandages, ribbons, etc.

In the specification there has been set forth a preferred embodiment of the invention, and although specific terms are employed, they are used in a generic and descriptive sense only and not for purpose of limitation, the scope of the invention being defined in the claims.

We claim:

1. A process for enhancing the surface of a fabric comprising the steps of:

providing a textile fabric formed from a plurality of fibers, said fabric comprising a woven or knitted fabric;

pre-abrading at least one substantially entire surface of said textile fabric to form a plurality of cut fiber ends and treating said at least one substantially entire surface of said textile fabric with a high energy fluid, to thereby form a substantially uniform surface effect on the textile fabric, wherein said step of treating the fabric with a high energy fluid is performed to apply at least about 0.0295 horsepower-hr/lb of energy to the fabric; wherein said steps of pre-abrading and treating result in cut fiber ends, and said cut fiber ends have a length of about 1.5 float lengths or less.

2. A process according to claim 1, wherein said fabric contains filaments.

3. A process according to claim 1, wherein said step of pre-abrading comprises a process selected from the group consisting of sanding, brushing, napping, wet sueding, and dry sueding.

4. A process according to claim 1, wherein said step of treating the fabric with a high energy fluid comprises a process selected from the group consisting of high pressure gas treatment, and high pressure liquid treatment.

5. A process according to claim 1, wherein said step of pre-abrading is performed on only one surface of the fabric.

6. A process according to claim 1, wherein said step of treating the fabric with a high energy fluid is performed on only one surface of the fabric.

7. A process according to claim 1, wherein said step of treating the fabric with a high energy fluid is performed by way of a plurality of treatment stages.

8. A process according to claim 1, wherein said step of treating the fabric with a high energy fluid is performed by way of a single treatment stage.

9. A process according to claim 1, wherein said step of treating the fabric with a high energy fluid comprises a high pressure hydraulic treatment.

10. A process for enhancing the aesthetic characteristics of a filament containing textile fabric comprising the steps of:

providing a woven textile fabric comprising filaments in each of the warp and filling directions;

pre-abrading at least one substantially entire surface of said textile fabric to cut some fibers in each of the warp and filling; and treating said at least one substantially entire surface of the fabric with a high energy fluid, such that a substantially uniform surface effect is formed on at least one surface of said fabric and fibers from adjacent yarns are entangled with each other, wherein the surface effect is formed from short fibers having a length of about 1.5 float lengths or less.

11. A process according to claim 10, wherein said step of treating the fabric with high energy fluid is performed to apply at least about 0.0295 horsepower-hr/lb of energy to the fabric.

* * * * *